US007007421B2

(12) United States Patent
Kirschhoffer et al.

(10) Patent No.: US 7,007,421 B2
(45) Date of Patent: Mar. 7, 2006

(54) DECORATIVE SUPPORT ASSEMBLY

(75) Inventors: Jon A. Kirschhoffer, White Bear Lake, MN (US); Roger T. Hager, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 46 days.

(21) Appl. No.: 10/600,719

(22) Filed: Jun. 20, 2003

(65) Prior Publication Data

US 2004/0255499 A1 Dec. 23, 2004

(51) Int. Cl.
*G09F 3/20* (2006.01)

(52) U.S. Cl. ..... 40/658; 40/657; 248/316.7

(58) Field of Classification Search ..... 40/652, 40/657, 658; 248/316.7

See application file for complete search history.

(56) References Cited

U.S. PATENT DOCUMENTS

| | | | | |
|---|---|---|---|---|
| 3,965,599 | A * | 6/1976 | Ebner | 40/711 |
| 4,261,121 | A * | 4/1981 | Coon | 40/332 |
| 5,409,189 | A | 4/1995 | Luhmann | |
| 5,653,414 | A * | 8/1997 | Chimel | 248/316.7 |
| 6,403,206 | B1 | 6/2002 | Bries et al. | |
| 6,450,471 | B1 * | 9/2002 | Wear | 248/489 |

FOREIGN PATENT DOCUMENTS

FR 2643483 A1 * 8/1990

OTHER PUBLICATIONS

"French Memo Board" (picture enclosed) described in the "Background of the Invention" portion of the specification and commercially available well before the filing date of the subject application.

"Collage Board" (picture enclosed) wider but otherwise having essentially the same structure as the "French Memo Board"(picture enclosed) described in the "Background of the Invention" portion of the specification and commercially available well before the filing date of the subject application.

* cited by examiner

*Primary Examiner*—Joanne Silbermann
(74) *Attorney, Agent, or Firm*—William L. Huebsch

(57) ABSTRACT

A display assembly including a plurality of clips of resiliently flexible material, each of which clips has a rear portion, a front portion laying along a front surface of the rear portion, and an arcuate end portion joining ends of the rear and front portions and defining a passageway transverse of the front, rear, and end portions. A plurality of lengths of stretch release adhesive releasably adhere rear surfaces of the clips to a surface in a pattern determined by a person applying the display assembly; and at least one resiliently elastic cord is positioned to extend between the clips and through the passageways in the clips to form a web-like structure between the clips. The clips and cord are decoratively colored, so that the display assembly can be used only as a decorative assembly, or can be used to support one or more objects along the surface.

11 Claims, 3 Drawing Sheets

DECORATIVE SUPPORT ASSEMBLY

FIELD OF THE INVENTION

The present invention relates to assemblies that can be attached to surfaces (including vertical surfaces) and are both decorative and can be used to support objects along such surfaces.

BACKGROUND OF THE INVENTION

Assemblies are known that can be attached to surfaces (including vertical surfaces) and are both decorative and can be used to support objects along those surfaces. One such assembly is commercially designated a "French Memo Board", different sized versions of which are available from retail stores including Bed Bath and Beyond and Target in St. Paul, Minn. That assembly includes a backing member over the front surface of which extends a rectangular grid of elastic strips. The backing member is adapted to be hung on a vertical surface, whereupon various objects, such as photographs, can be inserted for storage and display between the strips and the backing member.

DISCLOSURE OF THE INVENTION

The present invention provides a display assembly that can be attached to a surface (including a vertical surface) and is both decorative and can be used to support objects along that surface, which assembly is more versatile in the form in which it can be used and provides more versatility in the means by which it can support objects compared to known prior art assemblies.

The display assembly according to the present invention includes a plurality of clips of resiliently flexible material, each of which clips has a rear portion, a front portion laying along a front surface of the rear portion, and an arcuate end portion joining ends of the rear and front portions and defining a passageway transverse of the front, rear, and end portions. A plurality of lengths of stretch release adhesive can be used to releasably adhere rear surfaces of the clips to a surface in a pattern selected or otherwise determined by a person applying the display assembly; and at least one resiliently elastic cord is positioned to extend through the passageways in the clips and between the clips to form a web-like structure between the clips.

The clips and cord can be decoratively colored, so that the display assembly can be used only as a decorative assembly, and/or the web like structure and the clips can be used to support a plurality of objects (e.g., pictures, papers, pens, sunglasses, combs, emery-boards, etc.) along the surface.

Preferably the display assembly includes at least 8 clips and at least 2 elastic cords, the ends of each of the elastic cords being joined to form the cord into a loop.

BRIEF DESCRIPTION OF DRAWING

The present invention will be further described with reference to the accompanying drawing wherein like reference numerals refer to like parts in the several views, and wherein.

DETAILED DESCRIPTION OF THE INVENTION

Figure 1:
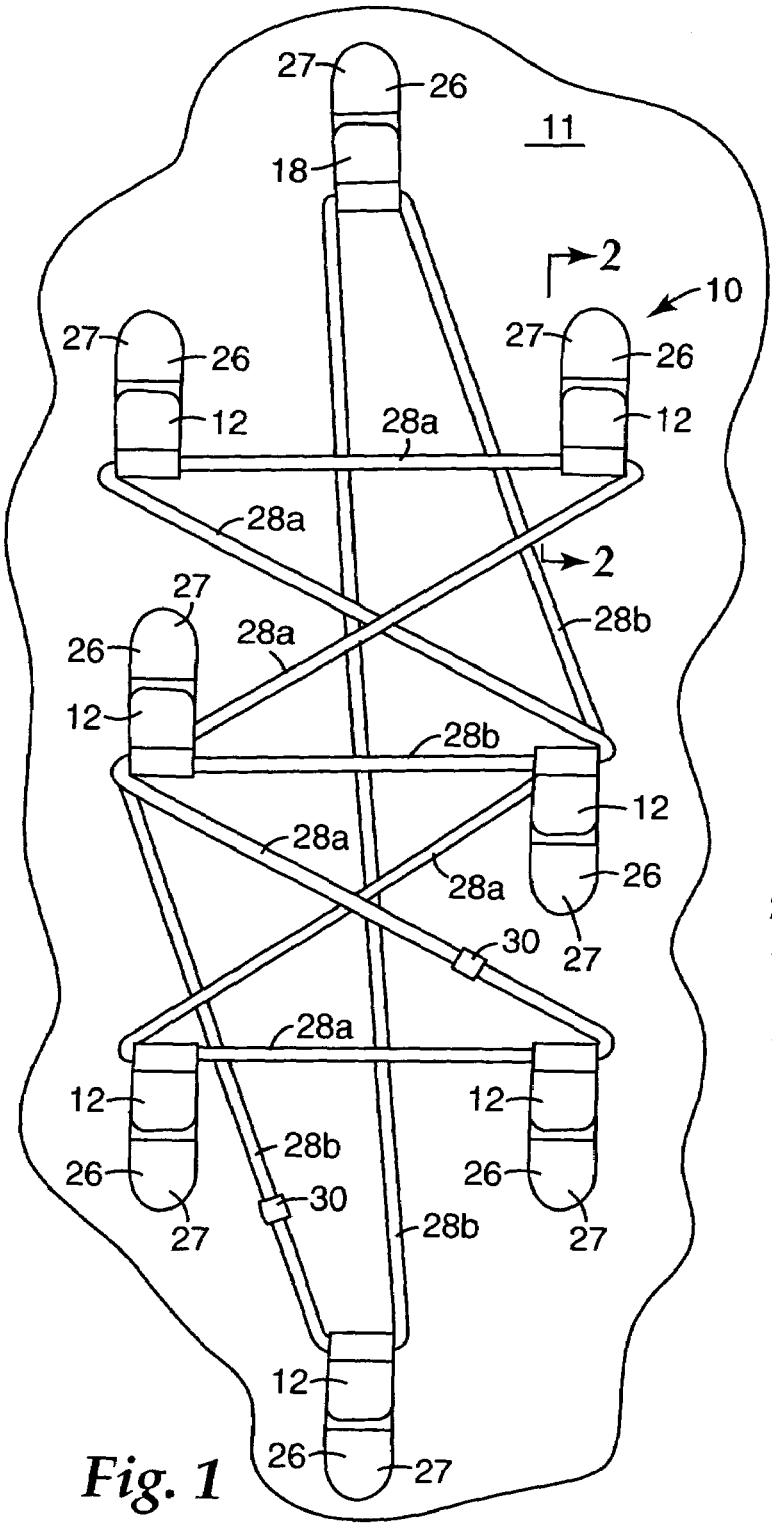
FIG. 1 is a front view of a display assembly according to the present invention shown attached to a surface in a first pattern.
Figure 3:
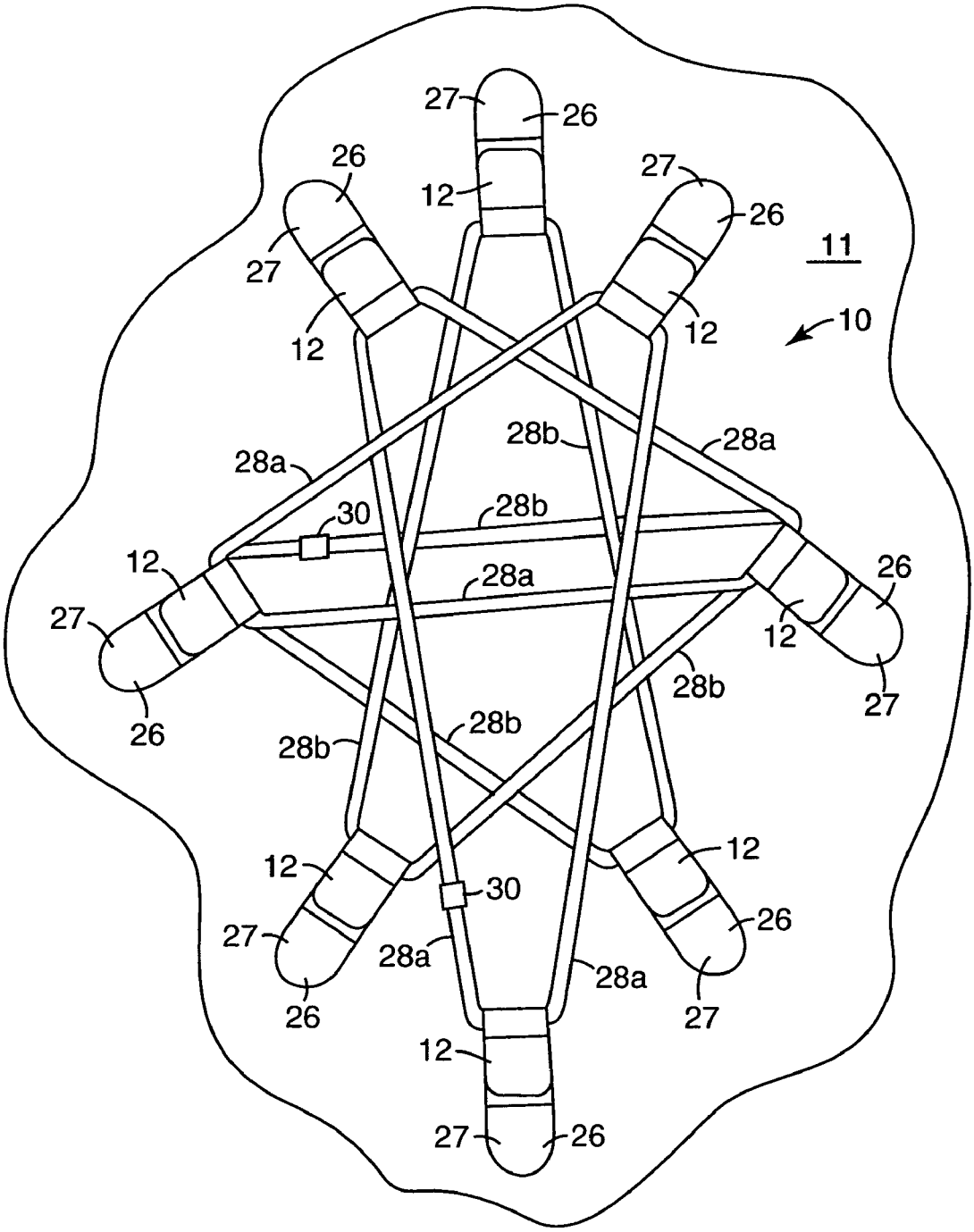
FIG. 3 is a front view of a display assembly according to the present invention shown attached to a surface in a second pattern.

Referring now to the drawing there is illustrated a display assembly 10 according to the present invention that can be attached in various patterns to a surface 11, such as in the pattern illustrated in FIG. 1, in the pattern illustrated in FIG. 3, or in a different pattern.

Figure 2:
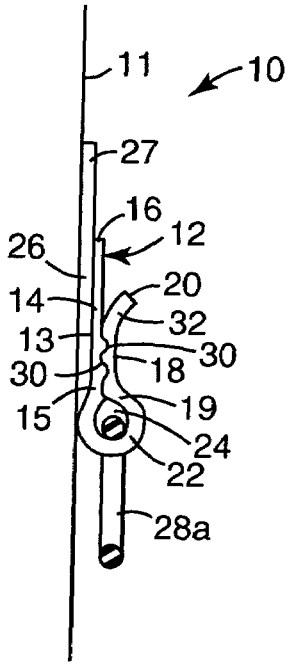
FIG. 2 is an enlarged sectional view taken approximately along line 2—2 of FIG. 1.

The display assembly 10 includes a plurality of clips 12 of a resiliently flexible material. Each of the clips 12 (see FIG. 2) has a rear portion 14 having a rear surface 13, an opposite front surface, and first and second spaced ends 15 and 16; a front portion 18 laying along the front surface of the rear portion 14 and having first and second spaced ends 19 and 20; and an arcuate end portion 22 joining the first ends 15 and 19 of its rear and front portions 14 and defining a generally cylindrical passageway 24 transverse of its front, rear, and end portions 18, 14, and 22. The display assembly 10 also includes a plurality of lengths 26 of stretch release adhesive that can releasably adhere the rear surfaces 13 of the clips 12 to the surface 11 in a desired pattern; and a plurality of resiliently elastic cords 28 (two cords 28*a* and 28*b* as illustrated), each of which elastic cords 28*a* and 28*b* as illustrated has its opposite ends joined together by a metal ferrule 30 to form the cord 28*a* or 28*b* into a loop. After the clips 12 are attached to the surface 11 the cords 28*a* and 28*b* can be positioned to extend through the passageways 24 in the clips 12 and between the clips 12 to form the cords 28*a* and 28*b* into a web-like structure between the clips 12.

As illustrated in FIGS. 1 and 3 the display assembly 10 can include eight clips 12 and two elastic cords 28*a* and 28*b* (each of which cords 28*a* or 28*b* can, for example, have a length of about 36 inches or 92 cm in length) and can be attached to the surface 11 in one of many different patterns by adhering the rear surfaces 13 of the clips 12 to the surface 11 in a desired pattern using the lengths 26 of stretch release adhesive, after which the cords 28*a* and 28*b* are inserted into and stretched between the clips 12. When desired, the display assembly 10 can be cleanly removed from the surface by stretching the lengths 26 of stretch release adhesive by pulling on a tab 27 at the end of each length 26, which stretching will release the adhesion of the length 26 of adhesive to the clip 12 and to the surface 11.

Figure 4:
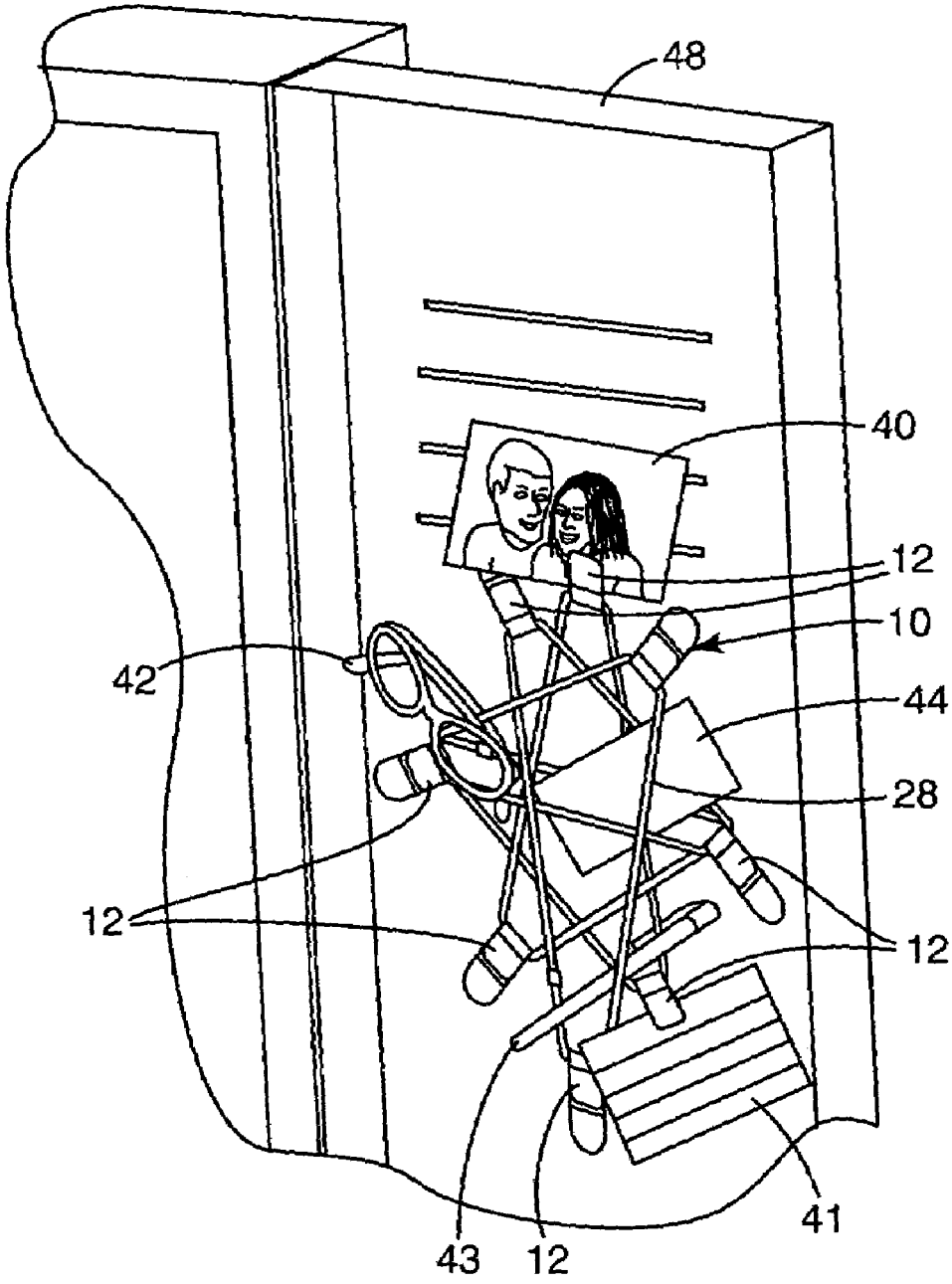
FIG. 4 is a perspective view of the display assembly according to the present invention attached to a vertical surface on a door of a school locker and being used to support a plurality of objects.

As seen in FIG. 4, the display assembly 10 can be used to support a plurality of objects (e.g., a picture 40 held in one of the clips 12. a card 41 held by a different clip 12, and sun glasses 42, a pen 43, and a letter 44 retained under the cords 28) along the vertical inner surface of a school locker door 48.

The elastic cords 28 should be strong, capable of being stretched to about twice their un-stretched length, and should require a significant force to stretch them. The cords 28 can each have a fabric covering that is colored in various different bright decorative colors along successive portions of its length (e.g., about 4 to 8 inch or 10 to 20 cm portions in each color), can have a diameter of about 0.13 inch or 0.33 cm when not stretched, and can require about 0.14 pounds per inch to stretch it to twice its length. A suitable elastic cord 28 having these properties is commercially available from King Wo Industries (International) Ltd., Kowloon, Hong Kong.

The clips 12 can be molded of a resiliently flexible polymeric material (e.g., polypropylene) each in one of several different bright colors, with the passageways 24 through each clip 12 having a diameter (e.g., about 0.2 inch or 0.51 cm) which allows two parts of the cords 28*a* and 28*b* to be positioned in the passageway 24 without pushing its front portion 18 away from its rear portion 14. The front portion 18 of each clip 12 presses firmly against its rear portion 14 and those portions 18 and 14 have opposed transverse ribs that nest between each other to provide undulating mating surfaces 30 that help to firmly hold a sheet (e.g., a picture, card or letter) between them. A part 32 of the front portion 18 adjacent its distal end 20 is curved away from the rear portion 14 to facilitate inserting the cords 28 and any sheet materials between the portions 18 and 14. The rear surface 13 of the rear portion 14 of each clip 12 is planar. It is that planar rear surface 13 to which one of the lengths 26 of stretch release adhesive is adhered when it adheres the clip 12 to the surface 11. The arcuate end portion 22 projects past (i.e., normal to) the rear surface 13 a distance (e.g., about 0.035 inch or 0.09 cm) just slightly less than the thickness of the lengths 26 of stretch release adhesive so that the arcuate end portion 22 will lay closer than the rear surface 13 of the rear portion 14 to a surface (e.g., the surface 11) to which the clip 12 is attached by one of the lengths 26 of stretch release adhesive. This then positions the cords 28*a* and 28*b* close to (i.e., about the thickness of the arcuate end portion 22 from) that surface to help hold thin objects against that surface. As an example, each clip 12 can have a width of about 0.625 inch or 1.6 cm, a rear portion 14 length of about 1.125 inch or 2.86 cm, and a thickness of the arcuate end portion 22 of about 0.075 inch or 0.19 cm.

The lengths 26 of stretch release adhesive 26 are preferably made as described in U.S. Pat. No. 6,403,206 (Bries et al. ), or the corresponding International Published Application WO 95/06691. Generally, such lengths of stretch release adhesive each comprise a central layer of polymeric foam (e.g., polyolefin foam), two layers of stretchable polymeric film (e.g., polyethylene or polypropylene film, with linear low density and ultra linear low density polyethylene film being preferred) bonded along opposite major surface of the layer of foam, and outer layers of stretch release that are adhered along the surfaces of layers of film opposite the central layer of polymeric film except at one end that provides the 27. When that length of stretch release adhesive is sequentially stretched by pulling on the 27, the layers of adhesive 14 and 23 will release respectively from the surfaces to which they adhered. Preferably the lengths 26 of stretch release adhesive 26 are about 0.63 inch or 1.6 centimeters wide and about 1.88 inch or 4.8 cm long including the tab portion 27 which is about 0.75 inch or 1.9 cm long; such lengths 26 of stretch release adhesive being commercially available from 3M Company, St. Paul, Minn. under the trademark "Command Adhesive".

Alternatively, the attachment strip used in the tape laminate 10 and the other tape laminates described below could consist of two layers of adhesive that define the major adhesive surfaces adhered along opposite major surfaces of a single layer of stretchable polymeric film, or could be the attachment strip described in U.S. Pat. No. 5,409,189 (Luhmann), which attachment strip consists of a single layer of pressure sensitive adhesive that would define the two major adhesive surfaces, and has a polymeric film covering over its projecting tab end portion to provide non-sticky surfaces for its tab portion by which the layer of pressure sensitive adhesive can be stretched to cause it to release from surfaces between which it has been adhered.

The patterns in which the display assembly 10 is attached to the surface 11 should provide a large number of crossing portions of the cords 28*a* and 28*b* within a perimeter defined by the clips 12 to form the web like structure. The pattern illustrated in FIG. 1 accomplishes this by positioning the cord 28*a* in a first pattern that includes two triangular portions on opposite sides of a parallelogram portion, which cord 28*a* in that first pattern overlays the cord 28*b* that is supported in a second generally elongate figure eight pattern. The pattern illustrated in FIG. 3 accomplishes this by positioning the two cords 28*a* and 28*b* in first and second overlaying patterns each of which patterns has generally the shape of a five pointed star with the points of the star in one pattern positioned between the points of the star in the other pattern.

The present invention has now been described with reference to one embodiment and several variations, modifications, and uses thereof. It will be apparent to those skilled in the art that many changes can be made in the embodiment described without departing from the scope of the present invention. For example, any number of clips 12 and cords 28 can be used to make a display with two to twelve clips 12 and one to six cords 28 being the most practical, and the shapes of the displays that can be made are limited only by the imagination of the user. Any one cord may not have its ends joined, but can instead have knots or structures attached at its ends to prevent those ends from slipping through the passageways 24 in the clips 12. Thus, the scope of the present invention should not be limited to the structures and methods described in this application, but only by the structures and methods described by the language of the claims and the equivalents thereof.

What is claimed is:

1. A decorative display assembly including:

a plurality of clips of resiliently flexible material, each of said clips having a rear portion having a rear surface, a front surface opposite said rear surface, and first and second spaced ends; a front portion laying along the front surface of said rear portion and having first and second spaced ends, and an arcuate end portion joining the first ends of said rear and front portions and defining a passageway transverse of said front, rear, and end portions;

a plurality of lengths of stretch release adhesive by which the rear surfaces of said clips can be releasably adhered to a surface in a predetermined pattern; and at least one resiliently elastic cord that can be positioned to extend through the passageways in the clips and between the clips to form a web-like structure between the clips;

the rear surface of the rear portion of each of said clips being planar, and said arcuate end portion projecting past the planar rear surface of the rear portion a distance slightly less than a thickness of said lengths of stretch release adhesive so that the arcuate end portion will lay closer than the rear portion to the surface to which the clip is attached by one of the lengths of stretch release adhesive.

2. A display assembly according to claim 1 wherein said elastic cord has opposite ends joined to each other to form the cord into a loop.

3. A display assembly according to claim 1 wherein said display assembly includes at least 8 clips and at least 2 elastic cords.

4. A display assembly according to claim 1 wherein said elastic cords when unstretched have a diameter of about 0.13 inch, and said passageways in said clips have diameters of about 0.2 inch.

5. A display assembly according to claim 1 wherein the front portion of each of said clips presses firmly against the rear portion of the clip and those portions have opposed transverse ribs that nest between each other to provide undulating mating surfaces that can help to firmly hold a sheet between said front and rear portions.

6. A display assembly including:

a plurality of clips of resiliently flexible material, each of said clips having a rear portion having a rear surface, a front surface opposite said rear surface, and first and second spaced ends; a front portion laying along the front surface of said rear portion and having first and second spaced ends, and an arcuate end portion joining the first ends of said rear and front portions and defining a passageway transverse of said front, rear, and end portions;

a plurality of lengths of stretch release adhesive releasably adhering the rear surfaces of said clips to a surface in a predetermined pattern; and at least one resiliently elastic cord extending through the passageways in the clips and between the clips to form a web-like structure between the clips;

the rear surface of the rear portion of each of said clips being planar, and said arcuate end portion of each of said clips projecting past the planar rear surface of the rear portion a distance slightly less than a thickness of said lengths of stretch release adhesive so that the arcuate end portion lays closer than the rear portion to the surface to which the clip is attached by one of the lengths of stretch release adhesive.

7. A display assembly according to claim 6 wherein said elastic cord has opposite ends joined to each other to form the cord into a loop.

8. A display assembly according to claim 6 wherein said display assembly includes at least 8 clips and at least 2 elastic cords.

9. A display assembly according to claim 6 wherein said web like structure and said clips support a plurality of objects to be displayed along the vertical surface.

10. A display assembly according to claim 7 wherein said elastic cords when unstretched have a diameter of about 0.13 inch and the passageways in said clips have diameters of about 0.2 inch.

11. A display assembly according to claim 6 wherein the front portion of each of said clips presses firmly against the rear portion of the clip and those portions have opposed transverse ribs that nest between each other to provide undulating mating surfaces that can firmly hold a sheet between said front and rear portions.

* * * * *

UNITED STATES PATENT AND TRADEMARK OFFICE

CERTIFICATE OF CORRECTION

PATENT NO. : 7,007,421 B2
APPLICATION NO. : 10/600719
DATED : March 7, 2006
INVENTOR(S) : Jon A. Kirschhoffer It is certified that error appears in the above-identified patent and that said Letters Patent is hereby corrected as shown below:

Column 3
Line 45, delete "surface" and insert --surfaces--
Line 47, after "surfaces of" insert --the--
Line 49, delete "27" and insert --tab 27--
Line 50, delete "27" and insert --tab 27--
Line 52, after "they" insert --are--

Column 6
Line 18, delete "claim 7" and insert --claim 6--

Signed and Sealed this

Sixth Day of February, 2007

JON W. DUDAS
*Director of the United States Patent and Trademark Office*